US006106364A

United States Patent [19]

Kruppke et al.

[11] Patent Number: 6,106,364

[45] Date of Patent: Aug. 22, 2000

[54] PROCESS FOR TORQUE FREE OUTER CIRCUMFERENCE GRINDING OF A CYLINDRICAL JOURNAL

[75] Inventors: Volker Kruppke, Stuttgart; Norbert Rau, Kirchheim; Michael Seibold, Schwaebisch Gmuend, all of Germany

[73] Assignee: DaimlerChrysler AG, Stuttgart, Germany

[21] Appl. No.: 09/154,717

[22] Filed: Sep. 17, 1998

[30] Foreign Application Priority Data

Sep. 17, 1997 [DE] Germany ..... 197 40 926

[51] Int. Cl.[7] ..... B24B 49/00

[52] U.S. Cl. ..... 451/5; 451/10; 451/11; 451/49

[58] Field of Search ..... 451/10, 11, 49, 451/51, 178, 242, 246

[56] References Cited

U.S. PATENT DOCUMENTS 5,289,660 3/1994 Terasaki et al. .
5,549,504 8/1996 Bishop .
5,746,643 5/1998 Terasaki et al. .

FOREIGN PATENT DOCUMENTS 37 37 641 4/1989 Germany .

*Primary Examiner*—Timothy V. Eley
*Assistant Examiner*—Willie Berry, Jr.
*Attorney, Agent, or Firm*—Evenson, McKeown, Edwards & Lenahan, PLLC

[57] ABSTRACT

A process for grinding a cylindrical journal is provided, in which the workpiece is rotationally drivably received and held in a work spindle. The grinding disk, which is cylindrically trimmed on its outer circumference, is brought into engagement with the journal to be ground. In order to be able to avoid twist structures during the cylindrical grinding, or at least to keep them within tolerable limits, while approaching the desired circumferential speed of the grinding disk and that of the workpiece within a respectively permissible spread, the rotational disk speed under a load during the grinding and/or the rotational workpiece speed under a load is/are continuously changed during each grinding operation and/or adjusted such that the ratio of the rotational disk speed to the rotational workpiece speed is disharmonic to as high a degree as possible; that is, that integral or simple fractional ratios of the disk rotational speed to the workpiece rotational speed are avoided. During the trimming of the grinding disk, a trimming advance of from 0.05 to 0.415 mm per revolution of the grinding disks is maintained, in which case the grinding disk is trimmed only in one advancing direction. The axes of rotation of the workpiece and the grinding disk are aligned precisely in parallel to one another.

9 Claims, No Drawings

PROCESS FOR TORQUE FREE OUTER CIRCUMFERENCE GRINDING OF A CYLINDRICAL JOURNAL

BACKGROUND AND SUMMARY OF THE INVENTION

This application claims the priority of German Patent Application No. 197 40 926.1, filed Sep. 17, 1997, the disclosure of which is expressly incorporated by reference herein.

The invention is based on a process for the outer circumference grinding of a cylindrical journal on a workpiece. The workpiece is received in a work spindle in a rotatable manner and is rotationally drivable at a defined rotational workpiece speed and a defined circumferential speed. A grinding disk, which revolves at a defined rotational disk speed and at a defined circumferential speed and which is cylindrically trimmed on the outer circumference, is brought into a grinding engagement with the journal to be ground.

For a secure sealing function at shaft passage points through housing walls, in addition to the sealing ring provided with a ring-shaped radial sealing lip, the characteristics of the journal-side counterrotation surface must also be taken into account. As a rule, these are circumferentially ground journal surfaces. In addition to certain roughness values, the designing engineer also requires a torque free characteristic of the grinding structure for the shaft journal. A "torque free" characteristic means that the grinding structure is situated precisely in the circumferential direction and superimposed regular shaft portions are absent.

Using a rubber-elastic sealing edge, the radial sealing lip of the sealing ring rests against the surface of the shaft journal with a defined radial force and on a defined radial width. By means of the rotation of the shaft journal, the contact area of the sealing lip is deformed to a varying extent in the circumferential direction as a function of the local radial contact pressure. Smaller deformations are situated close to the edge and larger circumferential deformations are situated more in the center area of the contact strip. This results in a sensible tribological and Theological equilibrium with an oil flow which, on the one hand, ensures the lubrication of the contact zone and, on the other hand, a return mechanism which maintains the sealing function of the ring seal. This equilibrium must not be disturbed by the formation of a torque or twisting in the microstructure of the counterrotation surface. A torsional conveying effect in one or the other direction is to be avoided. In the case of a torque-induced conveying effect into the sealed interior of the housing, the seal would run dry. Exterior dirt would be conveyed into the contact zone and the seal would wear out prematurely and become leaky. Although a conveying effect directed to the outside would prevent a running-dry of the seal, it would result in a discharge of oil at the sealing point, which for various reasons must be more or less strictly rejected.

So far it has been widely assumed that the so-called plunge-cut grinding process results in torque-free structures. However, even by means of the insecure so-called thread method, it can be proven that, at least in the case of a certain combination of working parameters, also in the case of the plunge-cut process, torque structures can be formed on a workpiece surface which is finely machined in this manner. Without the targeted use of the special knowledge of the formation of twists and countermeasures derived therefrom, the plunge-cut grinding of torque-free structures is more a question of the accidental meeting of favorable process parameters. With respect to the cylindrical grinding of shaft journals, surprisingly, the formation of possible torque structures has not been considered significant or significant enough. The cause of premature seal failures is assumed to lie more with the seal and less with the journal surface and its microstructure.

Although by means of a so-called "sparking-out" after the termination of the grinding operation, as demonstrated by the applicant's investigations, a torque structure in the ground surface can be avoided, the shop term "sparking-out" relates to a continued operation, without a feeding motion, of the grinding wheel on the rotating workpiece until the emitted sparks are extinguished in the case of a dry grinding and for a correspondingly long period during a wet grinding. The longer the sparking out takes place, the lower the twist formation. However, for the torque-free sparking-out of the workpiece, it is required to maintain the operation of the sparking-out for at least 20 to 30 s. This would impair the cycle time of the grinding operation to an unacceptably high extent.

According to the applicant's experiences with a process developed by the applicant for determining torque or twist structures on finely machined cylinder surfaces, on the one hand, and with tightness and durability tests on installed seals, on the other hand, an absolute freedom from twisting is not the only device for achieving tightness and a high durability expectation on radial shaft sealing rings. Slight formations of a twist structure and/or a high number of threads with a respective low conveying cross-section also lead to tolerable results.

Twist formation during grinding takes place, on the one hand, by way of the trimming operation of the grinding wheel or by way of deviations of parallelism between the grinding wheel axis and the workpiece axis. The applicant therefore differentiates between various types of torques.

In the case of the trimming torque, a single-thread trimming spiral is first formed on the grinding disk by means of the trimming using a so-called nonwoven or using a single diamond grain. During the grinding process, corresponding to the lower rotational speed of the workpiece, this trimming spiral leaves a flatter line on the workpiece, which generally is transferred to the workpiece as a multiple-thread twist structure. In the case of a zero twist, the waviness, which is formed in the cross-sectional shape similar to that of the trimming twist, is situated precisely in the circumferential direction; that is a "twist" formation is observed which has the peculiarity that the twisting angle is precisely equal to zero. With respect to their formation, the trimming twist and the zero twist are to be assigned to the waviness and are superimposed on the grinding structure.

The grinding structure must clearly be differentiated from the waviness. The term "grinding structure" here relates to the grinding traces of the individual grains of the grinding disk on the workpiece surface. Corresponding to the circular path of the grinding disk circumference and correspondingly of the passing-by of the workpiece circumference, the abrasive grains in each case engage only temporarily with the workpiece surface. The grinding structure is formed of a plurality of surface-covering superimposed lens-shaped or fish-type notches of a length of approximately 0.5–1 mm and a width of about 1/10th of it, which are all aligned in parallel to one another. The grinding structure is therefore interrupted repeatedly and contains a high stochastic form proportion. In contrast, the waviness of the trimming twist and the zero twist is uniformly formed along the whole sealing surface and has the characteristic of an interconnection. This means that the path of a twist extends continuously along the circumference. The interconnection will exist as long as the waviness proportion of the twist is at least formed to the same extent as the roughness proportion of the grinding structure.

The cause of the offset twist is an offset angle according to DIN 8630 as a deviation from the parallelism between the axis of rotation of the grinding disk and that of the workpiece. In the microstructure of the workpiece surface, the offset twist can be recognized in that the—not interconnected—grinding structure is sloped at a small angle with respect to the circumferential direction of the workpiece. Because of the slope of the grinding structure with respect to the circumferential direction, this surface structure—irrespective of the interconnected trimming twist -, in the interaction with a sealing lip, also has an axial conveying effect which may impair the durability of the shaft sealing ring.

Irrespective of whether it is a trimming twist or an offset twist, a twist formation will impair the sealing function of the surface the more or the higher the twist angle, the lower the number of threads and the larger the surface cross-section or the depth of one or several threads or of the grinding structure. In the case of a twist structure with a low number of threads, the individual threads have the tendency to be deeper, thus larger in the cross-sectional surface than in the case of higher thread numbers. So far, a large number of sealing surfaces with a twist structure were measured and a large variety was discovered in the twist formation.

It is an object of the invention to improve the process for the cylindrical grinding of shaft journals on which this application is based in that twist structures on grinding surfaces are avoided or can at least be kept within tolerable limits without a subsequent "sparking-out" in the case of all workpieces to be machined in one cycle.

According to the invention, this object is achieved by the process for the cylindrical grinding of a cylindrical journal on a workpiece. The workpiece is received in a work spindle in a rotatable manner and is rotationally drivable at a defined rotational workpiece speed and a defined circumferential speed. A grinding disk, which revolves at a defined rotational disk speed and at a defined circumferential speed and which is cylindrically trimmed on the outer circumference, is brought into a grinding engagement with the journal to be ground. During the trimming of the grinding disk, an axial trimming advance of 0.05 to 0.15 mm per grinding disk revolution is maintained and/or while approaching the desired circumferential speed of the grinding disk and of the desired circumferential speed of the workpiece within a respective permissible range, the rotational disk speed under a load during grinding and/or the rotational workpiece speed under a load during each grinding operation is/are continuously varied and/or adjusted such that the ratio of the rotational disk speed to the rotational workpiece speed is non-integral or does not represent a simple fractional ratio.

Accordingly, the invention starts with the causes of the formation of the two different types of twists and suggests different countermeasures for avoiding twists or torques. Indirectly, the invention recommends a twist formation which is as low as possible on the grinding disk itself during trimming and a large number of threads on the workpiece-side twist structure. For this purpose, the grinding disk and the workpiece are driven at rotational speeds whose ratio is disharmonic to as high a degree as possible. This can be achieved, among other measures, by avoiding integral or simple fractional ratios of the participating rotational speeds of the grinding disk and the workpiece. Thus, ratios should also be avoided which correspond to an integral number plus the value of a simple fraction with numbers below six in the numerator and/or denominator. A change of at least one of the participating rotational speeds during a grinding operation is also conceivable for achieving this object. By this measure, a tumbling synchronization of twist threads generated on the workpiece side with the disk-side trimming spiral is to be avoided.

In German Patent document DE 37 37 641 C2, with a view to achieving optimal surface roughnesses during plane grinding, certain ratios of the circumferential speed of the grinding disk and the workpiece are to be maintained, but the technical context is completely different there than in the present case. Although the known process involves a simultaneous grinding of a cylindrical circumferential surface, on the one hand, and a wavy shoulder, on the other hand, by means of a biconically trimmed grinding disk whose axis of rotation is sloped at a large angle with respect to the workpiece axis, the known grinding disk carries out a periodical axial lift corresponding to the wave shape of the wavy shoulder. In contrast, when grinding sealing surfaces according to the invention, no axial relative movement is to take place between the grinding disk and the workpiece. The cited prior art does not indicate the problem of an insufficient sealing effect of ground cylinder surfaces and its elimination.

A careful trimming of the grinding disk with a slight advance recommended according to the invention already causes a twist structure to slightly form on the workpiece. The measure, which is to be recommended additionally or as an alternative, of providing highly fractional rotational speed ratios of rotational disk speeds to rotational workpiece speeds aims in the same direction. The more complicated the fraction of the rotational speed ratio at least at the end of the grinding operation, the more threads the twist structure will have and the weaker the construction of its individual threads.

According to the invention, the trimming twist can be reduced at least to tolerable measurements by the careful trimming of the grinding disk and/or by avoiding integral or simple-fraction ratios of the rotational speeds. However, independently of the above, a possible offset twist will still exist which is caused by a parallelism defect of the grinding disk axis and the workpiece rotation axis. An occurring offset twist can be avoided in that the cause of its formation is eliminated; that is, that the axis of rotation of the workpiece and that of the grinding disk are aligned precisely in parallel to one another.

The advantages of the invention are, that through the use of the targeted adjustment of machine parameters during plane or cylindrical grinding, a twist structure on finely machined journal surfaces can be avoided or be kept within tolerable limits, without any increase of the machining time.

After the above, more general explanations concerning the invention, the measures will be explained in the following which are possible according to the invention for avoiding or reducing twists, partly by means of a numerical example and partially with reference to the technological sequences.

DETAILED DESCRIPTION OF THE PREFERRED EMBODIMENTS

A first—but not only—prerequisite for a twist-free plane grinding of a cylindrical journal is the fact that the journal surface is ground without an axial advance but only by means of a radial advance of the grinding disk. The grinding disk must therefore be wider than the axial length of the cylindrical journal surface to be machined in the grinding process so that the grinding of the cylinder surface can be finished by means of a simple radial feeding movement of the disk onto the workpiece.

The workpiece is received in a precisely rotatably disposed work spindle of the grinding machine which rotates at a relatively low rotational workpiece speed. As a result, the workpiece surface to be ground is to be provided with a certain rotating-past or circumferential speed which was previously optimized for the workpiece material and disk material combination. In addition to the feeding speed, this workpiece-side circumferential speed is responsible for the removal rate of the grinding process. The circumferential speed in the case of a defined material of the workpiece and of the grinding disk has the tendency to be constant in a first approximation along the different workpiece diameters. During the grinding, small workpieces therefore rotate at high rotational speeds and large workpieces rotate at low rotational speeds.

The grinding disk is rotatably disposed in a spindle head of the grinding machine, in which case—apart from certain parallelism defects which, as a rule, are not intended—the axis of rotation of the grinding disk is aligned in parallel to the workpiece axis. In addition to an axial displaceability, which is not of interest here, of the spindle head carrying the grinding disk for the adjustment of the correct axial relative position of the workpiece and the grinding disk, the spindle head can mainly be moved at a distance from the workpiece and is provided with a sensitively variable feeding drive. In the case of each newly chucked workpiece, the grinding engagement is established by the careful approaching of the rotating grinding disk or its circumference to the surface of the workpiece to be ground. By the extent of the radial feeding movement of the rotating grinding disk into the moved workpiece surface, on the one hand, and by the circumferential speed of the workpiece surface, on the other hand, the amount of the removal rate is determined which is essential for the grinding process. On the one hand, a high removal rate is desirable for achieving short cycle times; on the other hand, this removal rate must not be too high because, despite the intensive cooling of the workpiece by cooling water, there is the danger of a local overheating of the material. This mainly also concerns grinding disk conditions of several grinding operations after a trimming of the disk in which the disk during the grinding has a higher frictional effect than in the freshly trimmed condition and will then also—as a result of the friction—carry more waste heat into the workpiece.

A machining overmeasure is provided on the workpiece for implementing a cylindrical surface with a high accuracy of measurements and form, as well as a high surface quality. This machining overmeasure is removed in several workpiece rotations under a radial feeding of the grinding disk. The removal rate may be selected to be slightly higher at the start of the grinding operation. Toward the end, that is, when the finished measurement of the workpiece is reached, a reduction of the feeding movement and thus a reduction of the removal rate can be recommended. By means of a careful adjustment of the working parameters toward the end of the grinding process, a better surface quality is achieved on the workpiece. At the end of the machining, within each grinding operation, in each case at least one complete workpiece rotation must be carried out without a feeding of the grinding disk in order to change from the spiral approaching of the finished measurement to the desired cylindrical shape of the grinding surface.

The grinding disk is driven at a defined circumferential speed which was also empirically optimized with respect to the given pairing of workpiece material, on the one hand, and the type and material of the grinding disk, on the other hand. In order to constantly ensure a precisely cylindrical disk shape and to continuously expose new sharp abrasive grains at the disk circumference, the grinding disk must be trimmed again after several—for example, ten—grinding operations, which is carried out by means of a trimming tool—a so-called diamond nonwoven or a single diamond grain—in the manner of a turning operation. By means of this trimming, the outside diameter of the grinding disk is gradually reduced. In order to be able to maintain the desired circumferential speed of the grinding disk despite the diminishing disk size, to the extent of the reduction of the diameter, the rotational speed of the disk must be increased during the grinding. The drive of the grinding disk is therefore provided with a continuous rotational speed control. In the case of modern grinding machines, this takes place by means of an electric control of the driving motors.

In order to obtain, during the grinding, a twist structure of a formation which is as slight as possible, it is recommended according to the invention that the grinding disk be trimmed as carefully as possible, that is, with a slight advance per grinding disk rotation. However, in this case, it is not optimal to trim infinitely slowly. On the one hand, the trimming advance must not become too small because the trimming operation would be too long and impair the productivity of the grinding machine. On the other hand, an extremely small trimming advance would result in very finely broken abrasive grains in the working surface of the grinding disk. As a result, the grinding disk would act as a finer-grained grinding disk and, under the working parameters selected for the actually coarser-grained disk, result in overheating. An optimal lower limit of the trimming advance cannot be indicated as a generally valid value. On the contrary, in this respect, the optimum of a lowest-possible trimming advance must be determined empirically as a function of the workpiece material and of the disk material. However, a good orientation value for the lower limit of the trimming advance would be in the proximity of 0.05 mm per disk rotation. In order to be able to trim a grinding disk with a grinding width of 50 mm in the case of a trimming advance of 0.05 mm per revolution, the grinding disk would therefore have to carry out 1,000 revolutions. In the case of a rotational disk speed of 1,500 revolutions per minute, approximately 40 seconds would be required for this purpose.

From a productivity aspect, the user would naturally like to trim much more rapidly. However, the applicant's experiences with the above-mentioned, very precisely operating twist structure determination process demonstrate clearly that, starting from a certain upper limit of the trimming advance, the twist structures forming on the workpiece surface become so deep that running-surface-caused leaks of the sealing rings or reductions of durability cannot be excluded. In this respect, it is better to indicate a generally valid limit value, specifically the above-mentioned 0.15 mm per disk rotation. According to the above-mentioned numerical example, the essential operating time of the trimming operation would only amount to one third of the above-mentioned time, thus to approximately 13 seconds. Naturally, a twist-related deterioration in the case of larger trimming advances will start only gradually but the twist structure has the clear tendency to become deeper with an increasing trimming advance.

According to the applicant's experiences, it is not advantageous to trim the grinding disk by a forward movement and backward movement of the trimming tool. This only leads to an "asymmetrical" cross structure on the grinding disk surface, in which case the trimming spiral produced by the returning trimming tool is more pronounced. This cross structure forms completely analogously to the single spiral on the workpiece surface. Disadvantages of the double trimming with a forward movement and a backward movement are an increased wear on the trimming tool, an increased grinding disk shrinkage by trimming and a lengthening of the trimming time and therefore a reduction of the productivity. It is therefore recommended according to the invention that a trimming of the grinding disk take place in only one respective passage.

As mentioned above, the trimming spiral of the grinding disk is formed corresponding to the lower rotational speed of the workpiece in a multiple and steeper manner on its circumference. Specifically, in this case, the rotational speed ratio of the grinding disk to the workpiece is decisive. At a rotational speed ratio of ten to one, the trimming spiral of the grinding disk forms ten times on the surface of the workpiece. After each tenth rotation of the grinding disk, at this rotational speed ratio, the workpiece has just completed a rotation. During the eleventh rotation of the grinding disk, the workpiece has just completed 1.1 rotations, and the disk-side trimming spiral will then just fit back again into the first disk-side "image" of the spiral and hollow it out more.

The applicant was able to observe that—when viewing the cross-section of the twist threads in the axial direction—the flank angles of the threads are relatively small and remain within a narrow value range, which is explained by the formation method of the threads. However, this means that few threads of a twist structure are relatively deep and wide, specifically because the individual threads are met again by the trimming spiral of the grinding disk during each workpiece rotation. If, for example, ten workpiece rotations are required for a grinding operation and the rotational speed ratio is ten to one, this means that each thread of the workpiece-side twist structure is in each case met ten times by the disk-side trimming spiral and the thread is correspondingly wide and deep and thus contains a large conveying cross-section.

As explained above, at a rotational speed ratio of ten to one between the rotational speed of the grinding disk and the rotational speed of the workpiece, a ten-thread twist structure is formed. At a rotational speed ratio of 11:1, the number of threads is 11; at 12:1, there are 12 threads, and so on. The number of threads of the forming twist structure is therefore—at least at integral rotational speed ratios—a true image of the rotational speed ratio of the rotational disk speed to the rotational workpiece speed existing during the grinding operation. It is understood that the rotational speeds and their ratio which actually exist are important here, that is, exist under a load. In the case of non-integral rotational speed conditions, the situation involving the thread numbers is somewhat more complicated—the reason is that the threads can occur only as integrals in a twist structure.

If, in contrast, the load—rotational speed ratio of the grinding disk and the workpiece in the mentioned example (10:1) is changed by only 5%, thus, from 10,0 to 10,5, this means that the trimming spiral of the grinding disk arrives in a thread of the twist structure already existing on the workpiece surface only after 21 rotations of the workpiece. Thus, at this rotational speed ratio, a 21-thread twist structure is to be expected. In the case of the, for example, ten workpiece rotations within the whole grinding operation, each thread would be met only five times by the trimming spiral of the grinding disk. The threads would therefore be narrower and less deep. By avoiding the rotational speed ratio of 10:1 and maintaining an easily changed rotational speed ratio, the number of threads of the forming twist structure can therefore be significantly increased and the conveying cross-section of the individual threads can clearly be reduced. If the on-load speed ratio of the disk rotational speed to the workpiece rotational speed were brought, for example, precisely to 10.43. —at least theoretically—the trimming spiral would arrive back in a thread of a workpiece-side twist structure only after 1,043 disk rotations. In the case of a rotational disk speed in the proximity of 1,500 revolutions per minute, approximately 40 seconds would be required for this purpose. Frequently, the whole essential operating time of the grinding operation will not be as long. The conclusion can be drawn from the above that, in the case of highly fractional rotational speed ratios with rotational speeds which are set to the point at the grinding disk and at the workpiece and are maintained under a load, the effect of a repeated meeting of a twist thread already existing on the workpiece side by the disk-side trimming spiral during a grinding operation would not occur.

Because of the trimming-caused reduction of the diameter of the grinding disk and because of the requirement to maintain a certain cutting or circumferential speed of the grinding disk, during the life of a grinding disk, within a certain rotational speed range, there is a passing through the spectrum of the rotational speeds. New grinding disks, which still have large diameters, are, for example, at first operated at approximately 1,200 revolutions per minute—under a load. Toward the end of the useful life, the reduced grinding disk has to be driven at perhaps 2,000 revolutions per minute in order to offer the desired cutting speed at the circumference. At higher rotational speeds, there is the danger of a vibration excitation of the grinding machine by unavoidable residual imbalances of the grinding disk. In addition, at these rotation numbers, the centrifugal forces, which rise quadratically with the rotational speed, have values which represent a certain danger potential.

In contrast to the variably driven grinding disk, the workpieces are always driven at approximately the same circumferential speed and, according to the workpiece diameter, at a correspondingly constant rotational speed. Although the rotational workpiece speed can also be varied within relatively wide limits by the machine adjustment, as a rule, for grinding a certain type of workpiece, these are caused to rotate at a rotational speed which remains the same from one workpiece to the next. Small workpieces with a grinding surface diameter of, for example, 6 to 15 mm are driven at rotational workpiece speeds of from 300 to 500 revolutions per minute. If the grinding surfaces have a diameter of approximately 100 to 150 mm, rotational workpiece speeds of from 100 to 200 revolutions per minute are appropriate. If a rotational workpiece speed is, for example, 120 revolutions per minute under a load, in the case of a rotational speed spectrum of the grinding disk of from 1,200 to 2,000 revolutions per minute, this means that, during the life of a grinding disk, it passes through a spectrum of rotational speed ratios between 10:1 (value 10.0) in the case of a new disk, to 100:6 (value 16.66) in the case of an old disk.

It may be assumed that, at the cutting speed of the disk and at the circumferential speed of the workpiece, in each case, a spread of approximately ±2 to 3% about an optimal value can easily be tolerated. Under this condition, certain integral or simple-fractional rotational speed ratios of disks to workpieces can be skipped in that values are driven which are modified with respect to the optimal values of the disk-side and workpiece-side circumferential speed.

Coming back to the selected numerical example, one would therefore not start with a rotational speed ratio of 10.0 but, for example, with 9.57 or with 10.43 and would maintain the on-load speeds pertaining to this ratio unchanged on the workpiece side and on the disk side until the disk diameter has been reduced by approximately 5 to 7%. The mentioned "uneven-numbered" ratios can be represented as a true fraction only by high numbers in the numerator and/or in the denominator. This therefore leads to a high number of threads in a twist structure to be expected which, however, because of the high number of threads, is harmless with respect to the sealing function. A workpiece which is ground in this manner, at least with respect to the sealing result, can be considered in the same manner as a twist-free workpiece.

On the basis of the applicant's experiences, it may be stated that, starting from a certain number of threads, the forming of threads in a twist structure is so low that the threads are lost in the stochastic roughness. The interconnection of the free cross-section of such flat threads will be lost in the general surface roughness and is therefore acceptable with respect to the sealing effect. It is true that such a minimum number of threads, starting from which a twist structure is to be judged twist-free, cannot be indicated precisely from the start in a generally valid fashion, particularly since in this respect there also still seems to be a certain dependence on the diameter. On the circumference of a grinding surface of a small diameter, only relatively few harmful threads can be accommodated, whereas on the circumference of a large grinding surface, there is sufficient space for many harmful threads. According to the applicant's experiences, in the diameter range of 100 mm, twist structures with 40 and more threads are harmless for a perfect sealing effect. In the case of smaller grinding surfaces, this result could already be achievable by means of smaller thread numbers. Inversely, in the case of larger diameters of about 200 mm, probably clearly higher thread numbers would have to be demanded in order to ensure a tightness of the ground surface.

When, in the course of a progressing production, the disk diameter has been reduced by approximately 5% by a repeated trimming, a change will be made—starting from the value of the example of 10.43—to a new rotational speed value (under a load) of, for example, 10.83. The values should be selected such that the adjusted rotational speed ratios occurring under a load differ from whole or simple-fractional numbers by at least approximately 5%. This difference takes into account a certain regulating inaccuracy and an uncertainty of the process.

For all conceivable combinations of workpiece-side and disk-side rotational speeds, rotational speed ratios of approximately 3 to 30 may occur, in which case the lower value applies to small workpiece diameters and large new grinding disks, and the upper value is to be assumed for large workpieces and old small disks. In order to obtain ratios which are highly disharmonic in the case of the low ratios, significantly more "prohibited" ranges must be inserted between two successive whole numbers than at the upper end of the spectrum of ratios. In the case of fractional ratios of the rotational speeds, this value must be converted into a true simple fraction of whole numbers. The number of threads to be expected of a twist structure formed during grinding will then correspond to the numerator of such a fraction. If the rotational speed ratio under a load is, for example, 4.25—as a true simple fraction of whole numbers, this corresponds to $^{17}/_{4}$—a 17-thread twist can be expected. If the rotational speed ratio is $4.125=4+^{1}/_{8}=^{33}/_{8}$, 33 threads are formed. At a rotational speed ratio of $4.16666=4-^{1}/_{6}=^{25}/_{6}$, 25 threads are formed; at $4.83333=4+^{5}/_{6}=^{29}/_{6}$, 29 threads are formed. All these numbers of threads—17 or 25 or 29 or 33 threads—would still be harmful. In this range of low ratios, values would have to be found which are more disharmonically fractional in order to arrive at harmlessly high numbers of threads of above 40. This will be illustrated in the following table by means of arbitrarily selected examples:

| Decimal Ratio | Improper Fraction | Proper Fraction | Number of Threads to Be Expected |
|---|---|---|---|
| 3.818181 | 3 + 10/11 | 43/11 | 43 |
| 4.090909 | 4 + 1/11 | 46/11 | 46 |
| 4.1000 | 4 + 1/10 | 41/10 | 41 |
| 4.11111 | 4 + 1/9 | 37/9 | 37 |
| 4.3000 | 4 + 3/10 | 43/10 | 43 |

This shows that, at low ratios of the rotational speeds, these must be constantly maintained independently of the load and each separately in a very narrow percentage control range in order to be able to ensure a high number of threads. The smaller the ratios, the more critical the undesired rotational speed changes with respect to the desired rotational speed. Here, harmonic and low-degree disharmonic ratios, on the one hand, as well as high-degree disharmonic ratios, on the other hand, are situated close to one another. Although, at high ratios of the rotational speeds, a precise maintaining of the rotational speeds is no longer as critical because there harmonic and high-degree disharmonic ratios are situated farther apart than in the range of lower ratios, it is possible that, in the range of ratios which is decisive mainly in the case of large grinding diameters, higher numbers of threads than 40, for example, at least 50 or 60 threads, are to be endeavored in the twist structure of the grinding surface in order to be able to achieve a secure sealing effect on large journals. This is to be illustrated in several numerical examples in the range of ratios of 30 in the following table:

| Decimal Ratio | Improper Fraction | Proper Fraction | Number of Threads to Be Expected |
|---|---|---|---|
| 29.5 | 29 + ½ | 59/2 | 59 |
| 29.75 | 29 + ¾ | 119/4 | 119 |
| 30.0 | 30 | 30/1 | 30 |
| 30.125 | 30 + 1/8 | 241/8 | 241 |
| 30.25 | 30 + 1/4 | 121/4 | 121 |
| 30.1333 | 30 + 1/3 | 91/3 | 91 |
| 30.50 | 30 + ½ | 61/2 | 61 |
| 31.50 | 31 + ½ | 63/2 | 63 |

This overview demonstrates that, in the case of high ratios, it is sufficient to avoid integral values. With each non-integral ratio, thread numbers are reached which are above twice the ratio, which, as a rule, are sufficient.

In general, the following relationship applies to the rotational speed ratio of the rotational disk speed to the rotational workpiece speed: At a rotational speed ratio V written as in improper fraction of the general formula G+Z/N, a thread number of N*G+Z is formed. In this formula, G, Z and N are each whole numbers and G signifies the integral of the rotational speed ratio V, and Z/N is the fractional remainder of the rotational speed ratio V written in the form of a proper, simple, that is, no longer divisible fraction;

wherein Z=numerator and N=denominator; thus, V=G+Z/N. If it is now demanded that the number A of the threads must be larger than, for example, 40 ($A_{min}$=40) and the approximate amount of the rotational speed ratio, thus the integral G of this value, is also fixed (for example, G=5), by means of an iterative calculation with the modified numbers for Z and N, the precise value of a suitable rotational speed ratio can be determined, at which the required minimum number of threads is to be expected. By means of the above-selected numerical examples for $A_{min}$=40 and G=5, many possibilities would be obtained by trial, such as:

5+⅛=5.125 (A=41); 5+⅑=5.111 (A=46); 5+1/10=5.10 (A=51); 5+1/11=5.0909 (A=56), and so on.

It should be stressed again at this point that the rotational speed ratios are to be formed from actual rotational speeds; that is, from on-load speeds. Depending on the type of drive, the no-load speeds may clearly differ from the on-load speeds. Rotational speed drops in the case of asynchronous drives, depending on the amount of the load, may be at 3 to 7% of the nominal speed. Since, toward the end of the grinding operation before the specified size of the workpiece is reached, a lower feeding movement is frequently used, and therefore a load drop is to be expected toward the end of the grinding operation, the rotational speeds of the grinding disk will also rise here. In particular, toward the end of the grinding operation, the recommendation according to the invention with respect to "uneven-numbered" rotational speed ratios is to be observed. The machine-side condition is that the on-load speed of the workpiece and that of the grinding disk can be set with a high precision to arbitrary values in a precisely reproducible manner and also independently of the load can be held constant at the set value.

While the previously described approach for solving the twist problems by means of "uneven-numbered" rotational speed ratios aims in the direction of high thread numbers with an, on the whole, uncritical overall conveying cross-section of the surface waviness, a further solution approach of the invention goes in another direction. As the result of the continuous change of the rotational speed of the grinding disk and/or of the workpiece under a load during a grinding operation, a tumbling synchronization of the workpiece-side twist threads is to be penetrated by means of the disk-side trimming spiral. Because of the speed change of at least one of the two surfaces, in an optimal case, the trimming spiral of the disk arrives during each disk revolution on a previously not yet impacted circumferential point of the workpiece. As the result, a twist structure also with a very high twist number can be produced which therefore is harmless with respect to a sealing. Although, a continuous change of the rotational speed ratio passes through harmonic values, this is uncritical because these values are effective only for a short time.

A continuous change of the rotational speed ratio of disk rotational speeds to workpiece rotational speeds can be implemented in various manners. It will be assumed that the rotational speed within a band width of approximately 10% of the desired circumferential speed, while taking into account the respective existing disk diameter, can be changed during a grinding operation without technological disadvantages for the grinding process. Under this condition, the rotational speed of the grinding disk can be linearly lowered slowly during a grinding operation from 105 to 95% of the desired rotational speed. It is also conceivable to keep the rotational grinding disk speed in the case of an "uneven-numbered" rotational speed ratio in a first phase of the grinding operation with an increased removal rate at a first constant and only then linearly lower the rotational disk speed. The lowering of the rotational speed may, for example, take place by a simple switching-off of the driving motor of the grinding disk. It would then be possible to terminate the grinding operation by means of the driving energy stored in the grinding disk or in an additional flywheel disk at—according to an exponential function—a decreasing rotational speed. Naturally, the same advantageous effect of a virtually twist-free workpiece surface could also be obtained by means of a linearly rising rotational disk speed. The switching-off of the driving motor and/or the acceleration, for avoiding switch-on surges or the like, should take place by a careful voltage reduction—phase controlling—or by a targeted rotational speed control operation.

In the same manner, it can be assumed that the circumferential speed also of the workpiece can be varied within a band width of approximately 10% of the desired circumferential speed without technological disadvantages for the grinding process during a grinding operation. Thus, also the rotational workpiece speed, for interrupting a synchronization of the twist structure existing on the workpiece side and of the disk-side trimming structure, can be lowered or raised during the grinding operation within a 10% bandwidth by a desired rotational speed in a linear manner. Also, rotational changes in the opposite direction which supplement one another on the workpiece side and on the grinding disk are conceivable.

In addition to a linear rotational speed change (rising or falling) during a grinding operation, a synchronization of the structures can also be caused by a periodical rotational speed change. The grinding disk and/or the workpiece can be driven by means of a rotational speed which fluctuates about a mean value, in which case the rotational speed of the grinding disk and/or that of the workpiece under a load fluctuates about approximately ±3 to 8% of the respective mean value. In this case, the rise and fall of the rotational speed can take place linearly or according to a harmonic function or according to a time function which is not defined in detail. However, this suggestion is suitable only for smaller grinding disks or smaller workpieces with a low centrifugal mass. For example, such a fluctuating of the rotational grinding wheel speed can be carried out by an intermittent energizing of the disk driving motor. When the motor is switched off, because of the load moment of the grinding disk having a low mass, its rotational speed falls according to an exponential function. After another energizing, the rotational speed will rise again. This rise and fall can be repeated several times during a grinding operation. A fluctuating frequency of the rotational speed occurs in this manner. It seems expedient in this context that the fluctuating frequency is not constant but itself is varied so that twist-causing synchronization effects will not occur by way of this frequency. Instead of being avoided by means of a change of the fluctuating frequency, a possible twist-generating synchronization effect can also be avoided in that the fluctuating frequency is selected such that it is in a fractional relationship with respect to the respective participating rotational speeds.

In addition to an offset twist caused by parallelism defects of the axes of rotation and a trimming twist generated by the disk-side trimming spiral, the applicant could also observe a waviness shape on the grinding surface, in the case of which the period length of the workpiece-side waviness corresponds precisely to the trimming advance of the grinding disk, in which case, however surprisingly, the threads have no slope but extend exactly in the circumferential direction. The formation of this twist structure, which the applicant calls "zero twist", is uncertain. It can be explained by a small undesired axial lift of the grinding disk and/or of the workpiece within the scope of a normal free axial play of the grinding disk spindle or of the workpiece spindle. By means of the grinding engagement of the disk and the workpiece or by means of other, previously unknown influences, under certain circumstances, axial forces act upon the disk or the workpiece which cause a slight relative axial drift of at least one of the two partners. If this axial drift coincides with the trimming speed, a so-called zero twist could indeed be formed.

Although such a zero twist, because of an absence of an axial slope of the structure waves, causes no conveying effect on a ground journal surface under a sealing lip, the relatively deep wave crests situated in the circumferential direction generate an increased sealing lip wear which naturally is undesirable. Also, a so-called zero twist should therefore be avoided, if possible. This can take place in that a possible free axial play of the grinding spindle and of the workpiece spindle is avoided in that the spindles are axially prestressed clearly in the direction of a respectively assigned and integrated axial bearing. The axial bracing should take place by using a force which is higher than the possible axial forces occurring during the grinding process, for example, higher than the axial forces occurring during the trimming.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for grinding a cylindrical journal on a workpiece using a grinding disk that is cylindrically trimmed on its outer circumference, the workpiece being received in a work spindle in a rotatable manner and rotationally driven at a defined rotational workpiece speed and a defined circumferential speed, and the grinding disk being brought into a grinding engagement with the journal to be ground, said disk being rotationally driven at a defined rotational disk speed and a defined circumferential speed, wherein the process comprises at least one of the following acts:

maintaining an axial trimming advance of approximately 0.05 to 0.15 mm per grinding disk revolution during trimming of the grinding disk; and while approaching the defined circumferential speeds of the grinding disk and of the workpiece within respective permissible ranges, at least one of: a rotational disk speed under a grinding load and a rotational workpiece speed under the grinding load, is continuously adjusted to maintain a non-integral ratio of the rotational disk speed to the rotational workpiece speed which is not a simple fractional ratio.

2. Process according to claim 1, wherein ratios V of the grinding disk rotational speed to the workpiece rotational speed are maintained which correspond to a general formula $V=G+Z/N$, wherein G, Z and N are whole numbers respectively and G is an integral part of the rotational speed ratio V which is the approximate value of the rotational speed ratio to be maintained, and Z/N is a fractional remainder of the rotational speed ratio V in the form of a proper simple fraction, Z being the numerator and N being the denominator, and wherein a number A of threads of a twist structure on the workpiece to be expected during the grinding operation is the result of the equation $A=N\times G+Z$, and values of Z and/or N are selected such that the number A of threads formed are from 30 to 60, a smaller minimum number of threads applying to smaller grinding diameters and a larger minimum number of threads applying to larger grinding diameters.

3. Process according to claim 1, wherein toward an end of a grinding operation before reaching a desired size of the workpiece, non-integral ratios or ratios which correspond to a not simply fractional fraction of the rotational disk speed to the rotational workpiece speed are maintained.

4. Process according to claim 1 wherein during a grinding, at a continuously changing rotational speed of the grinding disk and/or of the workpiece under a load, the grinding disk and/or the workpiece is/are operated at a rotating speed which fluctuates about a respective mean value.

5. Process according to claim 4, wherein the rotational speed of the grinding disk and/or that of the workpiece under a load fluctuates about approximately ±3 to 8% of the respective mean value.

6. Process according to claim 5, wherein a fluctuating frequency at which the rotational speed of the grinding disk and/or that of the workpiece fluctuates about the respective mean value is changed itself continuously within the grinding operation.

7. Process according to claim 5, wherein a fluctuating frequency at which the rotational speed of the grinding disk and/or that of the workpiece fluctuates about the respective mean value is itself at a fractional ratio to the rotational speed of the grinding disk and/or the workpiece.

8. Process according to claim 1, wherein during a grinding operation, a grinding spindle and the work spindle are axially prestressed clearly in the direction of a respectively assigned and integrated axial bearing of a grinding machine.

9. Process according to claim 1, wherein the axis of rotation of the workpiece and that of the grinding disk are aligned precisely in parallel to one another.

* * * * *